US009790651B2

(12) United States Patent
Annan et al.

(10) Patent No.: US 9,790,651 B2
(45) Date of Patent: Oct. 17, 2017

(54) INDIVIDUAL SEAL ARRANGEMENT FOR CABLE ANCHORAGE

(71) Applicant: VSL INTERNATIONAL AG, Koniz (CH)

(72) Inventors: Rachid Annan, Rapperswil (CH); Adrian Gnagi, Bern (CH)

(73) Assignee: VSL International AG (CH)

( * ) Notice: Subject to any disclaimer, the term of this patent is extended or adjusted under 35 U.S.C. 154(b) by 0 days.

(21) Appl. No.: 14/893,457

(22) PCT Filed: May 30, 2014

(86) PCT No.: PCT/EP2014/061295
§ 371 (c)(1),
(2) Date: Nov. 23, 2015

(87) PCT Pub. No.: WO2014/191568
PCT Pub. Date: Dec. 4, 2014

(65) Prior Publication Data

US 2016/0122955 A1 May 5, 2016

(30) Foreign Application Priority Data

May 31, 2013 (GB) ..... 1309791.0
Dec. 24, 2013 (WO) ..... PCT/EP2013/077969

(51) Int. Cl.
*E04B 1/00* (2006.01)
*E01D 19/14* (2006.01)
(Continued)

(52) U.S. Cl.
CPC ..... *E01D 19/14* (2013.01); *E01D 19/16* (2013.01); *E01D 21/00* (2013.01); *E04C 5/12* (2013.01); *E04C 5/122* (2013.01)

(58) Field of Classification Search
CPC ..... E01D 19/14; E01D 19/16; E01D 21/00; E04C 5/12; E04C 5/122; E04C 5/127;
(Continued)

(56) References Cited

U.S. PATENT DOCUMENTS 4,363,462 A * 12/1982 Wlodkowski ..... E04C 5/12 24/115 M
4,592,181 A * 6/1986 Matt ..... E04C 5/12 52/223.13
(Continued)

FOREIGN PATENT DOCUMENTS

CN 200999418 Y 1/2008
CN 101210447 A 7/2008
(Continued)

OTHER PUBLICATIONS

International Search Report and Written Opinion for PCT/EP2013/077969 dated May 9, 2014, 10 pages.
(Continued)

*Primary Examiner* — Brian D Mattei
(74) *Attorney, Agent, or Firm* — Blank Rome LLP

(57) ABSTRACT

A cable anchorage is described for anchoring a cable, for example a stay cable comprising multiple strands (50), against an axial tension force. Each strand (50) is individually sealed in an individual channel (6) of the anchorage against moisture ingress, and each strand (50) may be removed and replaced individually. A tight-fitting elastic annular seal (26) is fitted into a recess (27) in the channel. The annular seal (26) is inserted from the anchor block end (1) of the anchorage.

19 Claims, 8 Drawing Sheets

(51) Int. Cl.
*E01D 19/16* (2006.01)
*E04C 5/12* (2006.01)
*E01D 21/00* (2006.01)

(58) Field of Classification Search
CPC .. E02D 5/808; E02D 2600/30; Y10T 24/3909
See application file for complete search history.

(56) References Cited

U.S. PATENT DOCUMENTS 4,633,540 A * 1/1987 Jungwirth ..... E04C 5/122 14/21
4,878,327 A * 11/1989 Nutzel ..... E01D 2/04 52/223.13
5,079,879 A 1/1992 Rodriguez
RE34,350 E * 8/1993 Dufossez ..... E01D 19/14 52/146
5,788,398 A * 8/1998 Sorkin ..... E04C 5/12 285/138.1
6,578,329 B1 * 6/2003 Stubler ..... E01D 19/14 24/122.6
2002/0108329 A1 * 8/2002 Bournand ..... E01D 19/14 52/223.13
2012/0058338 A1 * 3/2012 Fyfe ..... D07B 1/00 428/365

FOREIGN PATENT DOCUMENTS

| | | | |
|---|---|---|---|
| CN | 202787075 | U | 3/2013 |
| DE | 19711003 | A1 | 10/1998 |
| EP | 1227200 | A1 | 7/2002 |
| GB | 1418763 | | 12/1975 |
| JP | 61-54006 | U | 11/1986 |
| JP | 8-74210 | A | 3/1996 |
| JP | 2002309776 | A | 10/2002 |
| WO | WO-98/41709 | | 9/1998 |
| WO | WO-2012/140463 | A1 | 10/2012 |

OTHER PUBLICATIONS

International Search Report and Written Opinion for PCT/EP2014/061295 dated Aug. 27, 2014; 12 pages.

* cited by examiner

INDIVIDUAL SEAL ARRANGEMENT FOR CABLE ANCHORAGE

RELATED APPLICATIONS

This application is a national phase of PCT/EP2014/061295, filed on May 30, 2014, which claims the benefit of Great Britain Application No. GB1309791.0, filed on May 31, 2013 and PCT/EP2013/077969, filed Dec. 24, 2013. The entire contents of those applications are incorporated herein by reference.

BACKGROUND OF THE INVENTION

The present invention relates to the field of cable anchorages, such as may be used, for example, for anchoring longitudinal structural elements which are designed to be tensioned, such as wires, ropes, strands, tendons, stays or cables. In particular, but not exclusively, the invention relates to individual sealing arrangements for individual cable strands in such anchorages.

In order to illustrate the advantages of the invention, reference will be made to the application to stay cables. However, it should be understood that this application is not limiting, and that the principles underlying the invention may be applied to any kind of longitudinal structural elements which are designed to be tensioned, such as wires, ropes, strands, tendons, stays, cables etc.

Stay cables are used for supporting bridge decks, for example, and may typically be held in tension between an upper anchorage, secured to a tower of the bridge, and a lower anchorage, secured to the bridge deck. A stay cable may comprise dozens or scores of strands, with each strand comprising multiple (e.g. 7) steel wires. Each strand is usually retained individually in each anchorage, which may immobilise the strand using a tapered conical wedge seated in a conical hole in an anchor block, for example. Tensioning of the strands may be performed, from either one of the cable ends, using hydraulic jacks. The condition of the individual strands is typically monitored regularly to detect any corrosion or mechanical deterioration. If such deterioration is found in a particular strand, it may be de-tensioned, removed from the cable, replaced with a new strand and the new strand tensioned. If such a replacement operation is performed, great care must be taken to ensure that the new strand is sealed against ingress of moisture.

It has been proposed in European patent EP1227200B1, assigned to the same applicant, to provide individual sealing arrangements for each strand, so that an individual strand can be replaced and re-sealed without affecting the seals of the other strands. The proposed anchorage uses individual sealing rings, each held in place between two tight-fitting tubular elements which are assembled off-site, with the sealing ring trapped between them, when the anchorage is manufactured. When replacing a strand through this anchorage, care must be taken, when removing the old strand and inserting the new strand, not to damage the integrity of the seal. After tensioning, the exposed end of the cable may be protected by injecting grease or wax or gel into the cavity surrounding the strand inside the anchorage. The two tight-fitting tubular elements must be arranged such that, when replacing a strand, the two tubular parts do not move or deform relative to each other, and thereby permit a leak which may allow an ingress of moisture to circumvent the captive sealing ring. In such prior art the strand cannot be replaced easily without damaging the annular seal element 7 shown in FIG. 1 of EP1227200.

SUMMARY OF THE INVENTION

It is an object of the present invention to overcome this and/or other disadvantages of prior art anchorages. In particular, the invention aims to provide an anchorage and a method in which both the strand and the seal element can be replaced in a simple way.

According to the invention the cable anchorage plurality of axial channels for accommodating a strand of a cable. Strands may be any longitudinal tensile elements, that together form the cable. The channel extends along the whole length of the cable anchorage between a first channel end, proximal to a running part of the cable, and a second channel end, remote from the running part of the cable and equipped with strand-immobilising device. A seal element comprising an elastic material is positionable at a predetermined axial location of an inner wall of the channel before the strand is inserted into the channel. Thus the seal element provides a seal between the inner wall of the channel and the strand, when the strand is in the channel. The seal element and the second channel end of the channel are formed such that the seal element can be introduced into the channel through the second channel end. Further the seal element and the inner wall of the channel are formed such that the seal element is axially displaceable inside the channel from the second channel end to the predetermined axial location. To that end, the inner wall of the channel comprises an annular or cylindrical recessed region, longitudinally coaxial with the channel, for accommodating the seal element so as to retain the seal element at the predetermined axial location during an axial displacement of the strand in the channel. Also the seal element is elastically deformable to a compressed state, in which it has a radial outer dimension which is smaller than or equal to all diameters of the inner wall of the channel between said second channel end and said seal, and the sealing element is removably arranged in the recessed region.

In the method according to the invention in a first step the seal element is introduced into the channel through a channel end and in a second step the seal element is displaced axially inside the channel from said channel end to the predetermined axial location. For a cable anchorage located at the free end of a strand, in an anchor block, said channel end for introduction of the seal element is preferably said second channel end, remote from the running part of the cable. For a cable anchorage located at an intermediate portion of a strand, for instance with a saddle, said channel end for introduction of the seal element is preferably said first channel end, proximal to a running part of the cable.

According to the invention an insertion tool and a removal tool are provided for insertion and removal of the seal element into or out of the channel of the anchorage. In fact the insertion tool and the removal tool may be designed as an insertion and removal device such, that both functions may be fulfilled by the same device. The tool provide a system for performing the method steps according to the invention.

By accessing the predetermined axial location of the seal element from outside the channel already for the initial displacement of the seal element, it becomes possible to place the seal element without the need to disassemble tubular parts of a seal fitting or even to provide a joint between the tubular parts at the location of the seal element. That means already during first installation of the seal in the cable anchorage, the seal is placed from the remote end of the cable anchorage. Advantageously this allows to replace the seal element when a strand is replaced, thereby greatly improving the subsequent integrity of the seal for the new strand, while also speeding up the process of replacing the strand. Because the seal can be replaced at the time of replacing the strand, it is possible to eliminate or reduce the testing and/or monitoring of the effectiveness of the seal which would be necessary if the seal were not replaced. The use of a stiff, resilient material such as polyurethane ensures that the seal element regains its substantially undeformed or relaxed shape quickly and reliably when located in position at the predetermined axial position in the channel. The relative dimensions of the seal elements and the anchorage channels are such that each seal element may be inserted via the remote end of the channel, away from the running portion of the cable, where access is significantly easier than at the proximal end of the channel, toward the running portion of the cable.

BRIEF DESCRIPTION OF THE FIGURES

The invention will now be described in more detail with reference to the attached drawings, in which.

DETAILED DESCRIPTION OF THE INVENTION

Figure 1:
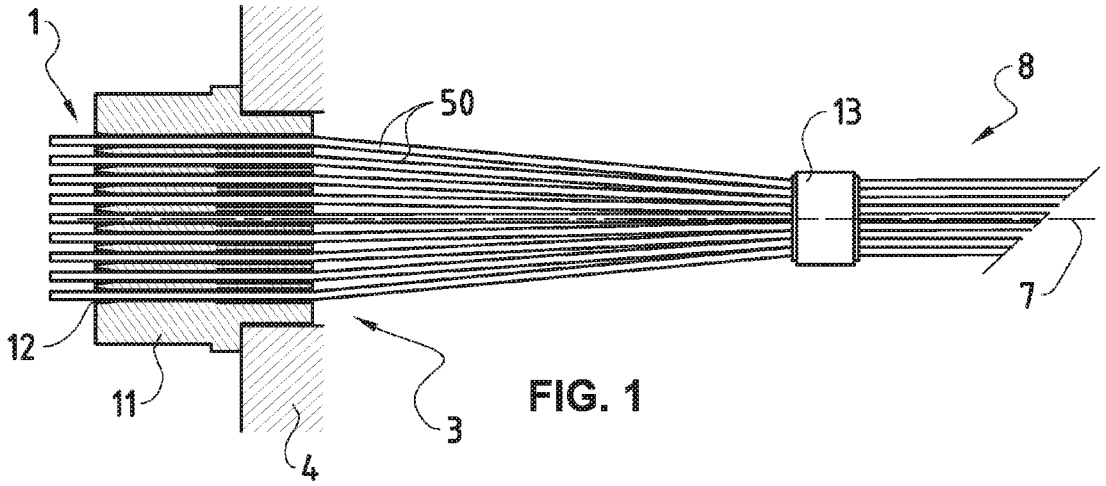
FIG. 1 shows in schematic cross-sectional view a cable anchored in a cable anchorage.

Note that the figures are provided for illustrative purposes only. They are intended as an aid to understanding certain principles underlying the invention, and they should not be taken as limiting the scope of protection sought. Where the same reference numerals are used in different figures, these are intended to refer to the same or corresponding features. However, the use of different numerals does not necessarily indicate any particular difference between the features to which they refer.

FIG. 1 shows a general schematic cross-sectional view of a cable anchorage in operation. Multiple strands 50 are threaded through axial channels 6 in an anchor block 11 and are held in place by, for example, conical wedges 12. The anchor block 11 is held in a structure 4 (part of a bridge deck, for a example) which is to be supported or tensioned by the cable. The various strands 50 of the cable are shown gathered together by a collar element 13, from where they proceed to the main running part 8 of the cable. Reference 7 indicates the principal longitudinal axis 7 of the cable and of the anchorage. Reference 3 indicates a first end as an exit end of the anchorage, proximal to the running part 8, while reference 1 indicates a second end of the anchorage, remote from the running part 8 of the cable.

Figure 2:
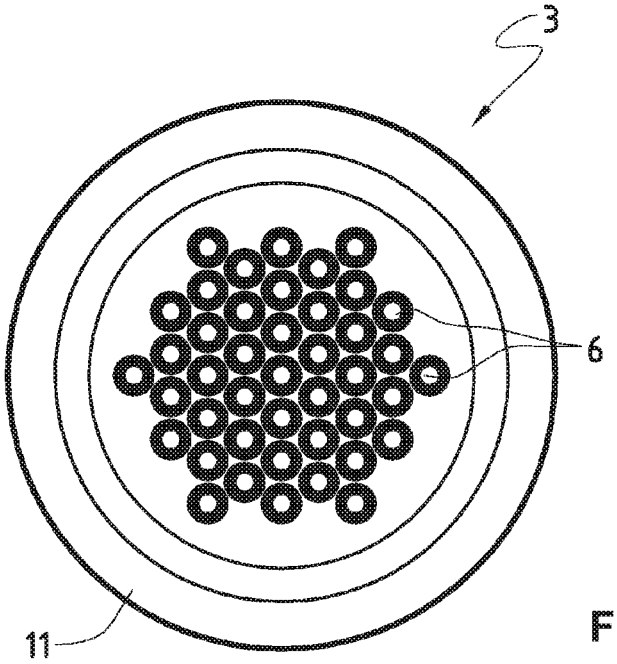
FIG. 2 shows in schematic form an example of a front-end view of a cable anchorage.

FIG. 2 shows a frontal view of an anchorage such as the one shown in FIG. 1, viewed from the proximal end 3, and omitting the strands 50. FIG. 2 illustrates in particular an example of an array arrangement of channels 6 through which the strands 50 pass when the anchorage is in operation. In FIG. 2, 43 strand channels 6 are illustrated, although other arrangements and numbers of channels 6 and strands 50 may be used. The strands 50 are accommodated in the cylindrical channels 6 which extend through the length of the anchorage, and are kept as close to each other as possible in the anchorage, so as to minimise the magnitude of any deviation of each strand 50 from the principal longitudinal axis 7 of the cable or the anchorage.

Figure 3:
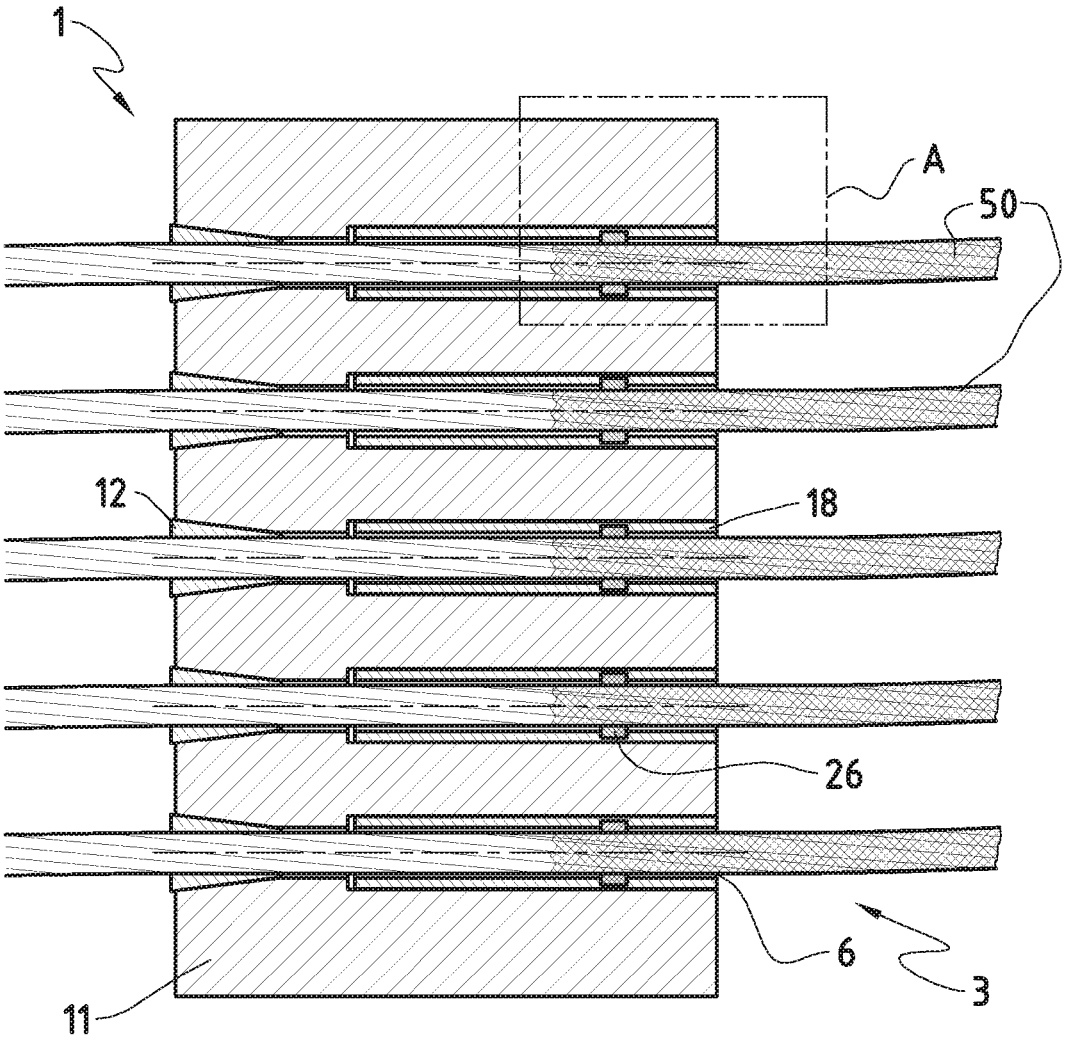
FIG. 3 shows a sectional view of a first example anchorage according to the invention.
Figure 4A:
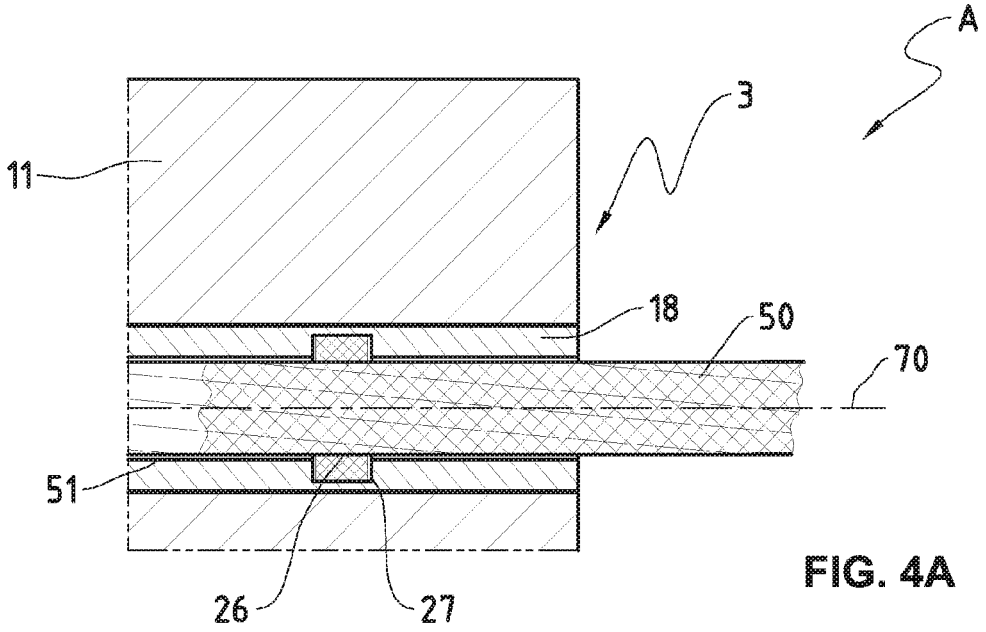
FIG. 4A shows an enlarged portion of the sectional view of FIG. 3.

FIGS. 3 and 4A show an example of a "passive end" anchorage, also known as a "dead end" anchorage. Such an anchorage is used simply to hold the ends of the strands 50 when they are under tension, and also while they are being tensioned from the other end of the cable (which is commonly known as the stressing end). A stressing end anchorage will be discussed in relation to FIGS. 7, 8 and 12.

Figure 4B:
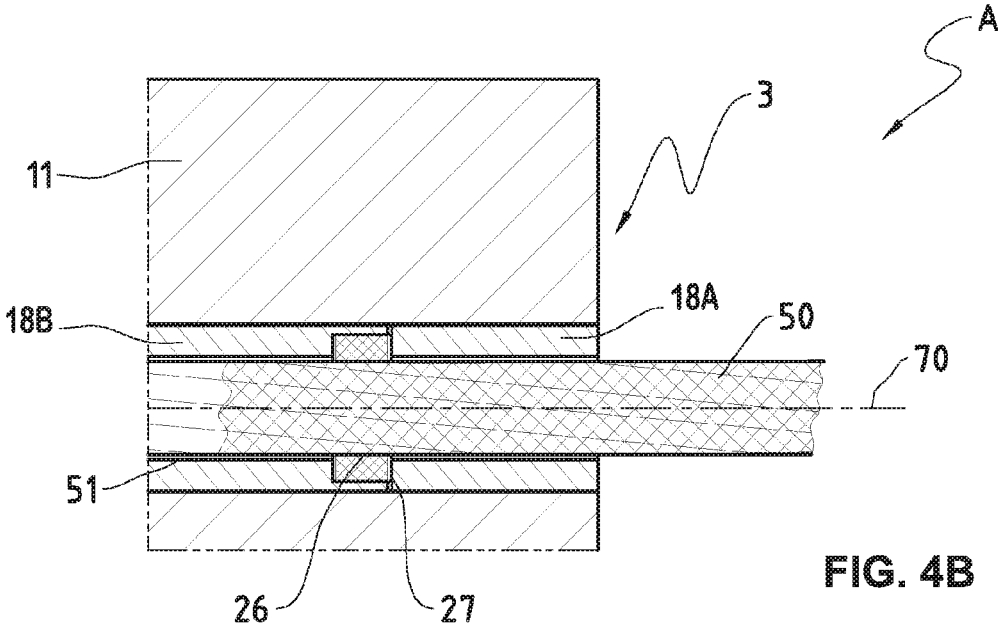
FIG. 4B is a similar view for a variant.

The passive end anchorage comprises channels 6 formed through an anchor block 11, which may for example be a block of hard steel or other material suitable for bearing the large axial tension forces in the cable. Strands 50 are held in place in the channels 6 by immobilising device such as conical wedges 12. Each channel 6 may be provided with an orifice element 18, located at or near the exit end 3 of the channel (also called proximal or first end), where the strand 50 emerges from the anchorage. The orifice element 18 may comprise a hard plastics material, for example, provided with a seal element 26 for providing a water-tight seal between the inner wall of the channel 6 (in this case the inner wall of the orifice element 18) and the outer surface of the strand 50. Also, notably for an easier manufacture, as shown in FIG. 4B, the orifice element 18 may be a two-piece part, the assembling of these two pieces 18A, 18B defining a boundary at the location of a recess for accommodating the inner seal 26. For instance these two pieces 18A, 18B are in plastic and friction welded before mounting in the anchorage so that said boundary is water tight.

Stay cable strands are typically sheathed in a protected polymeric material such as polyethylene (PE), which can be removed in the region of the strand where the strand is to be anchored. In the figures the sheathed parts of the strands 50 are distinguished from the stripped regions by cross-hatching. The strands 50 which are to be anchored in the anchorage are stripped of their polymer sheath in the end region of the strand 50 before the strand 50 is inserted into the anchorage channels 6. This is so that the wedges 12 can then grip directly on to the bare steel of the strand 50, instead of the sheath.

Once the sheathed strand 50 is fitted in the passive end anchorage, it is important to protect the bare portion of the strand 50 against the corrosive effects of atmospheric moisture. For this reason, the seal element 26 is fitted, under elastic compression, in a space 51 between the inner surface of the channel 6 (for example the inner surface of the orifice element 18) and the outer surface of the sheath of the strand 50. A protective wax, grease, polymer or other substance may also be injected or otherwise introduced into the space 51 between the strand 50 and the wall of the channel 6. In this case, the seal element 26 may serve as a barrier to the ingress of moisture into the cavity 51. It also may serve to retain a filler material 52 within the cavity 51 as shown with black filling on FIGS. 7, 8 and 12.

This filler material 52 may be a bedding material forming a bending cushion extending substantially around the strand 50 in the strand-channel 6. It is therefore also possible to change the filler material 52 surrounding the strand 50 by choosing a bedding material adapted to provide elastic bedding to reduce bending stresses originating from static and dynamic deviation of the strand. This bedding material also absorb and dissipates most of the vibratory energy accumulating in the strand when deflections of the strand occurs so as to provide damping by dissipation of energy under dynamic movements. To that end, the space surrounding the strand 50 in the strand-channel 6 is at least partially filled with a flexural and/or elastic bedding material having a predetermined durometer at 23° C. is in the range 10 to 70 Shore. Preferably the durometer value of in the bedding material 21 is in the range 10 to 30 Shore or even preferably in the range 15 to 25 Shore. Using the following relation between the hardness and the Young's modulus for elastomers.

$$E = \frac{0.0981(56 + 7.62336S)}{0.137505(254 - 2.54S)}$$

where E is the Young's modulus in MPa and S is the ASTM D2240 type A hardness used as durometer, the bedding material 21 used for the invention has preferably a stiffness defined by its Young's modulus in the range 0.4 to 5.5 Mpa, and more preferably in the range 0.4 to 1.1 or even preferably in the range 0.6 to 0.9 Mpa. This bending cushion creates reduction of the deflection stresses of the strands at the anchorage location: this bending cushion is able to reduce the bending stresses in the strand 50 by absorbing bending stresses along a bedding region. The bedding material may comprise a solid elastomeric or polymeric material, notably a viscoelastic polymer, such as polyurethane, epoxy-polyurethane, epoxy polymer or reticulated epoxy resin, for example.

The seal element 26 may be located near to the proximal end 3 of the channel, at a location referred to as the predetermined axial location. At this location, the seal 26 might in principle be easier to access from the proximal end 3 of the channel 6 than from the remote second end 1. However, the individual strand 50 is typically so crowded by adjacent or surrounding strands that this kind of access becomes difficult or impossible. For this reason, it is advantageous to access the seal element 26 from the remote end 1 of the anchorage. Examples of tools which can be used for the insertion and removal of seal elements 26 in the channels 6 are described with reference to FIGS. 9 to 14.

Figure 5:
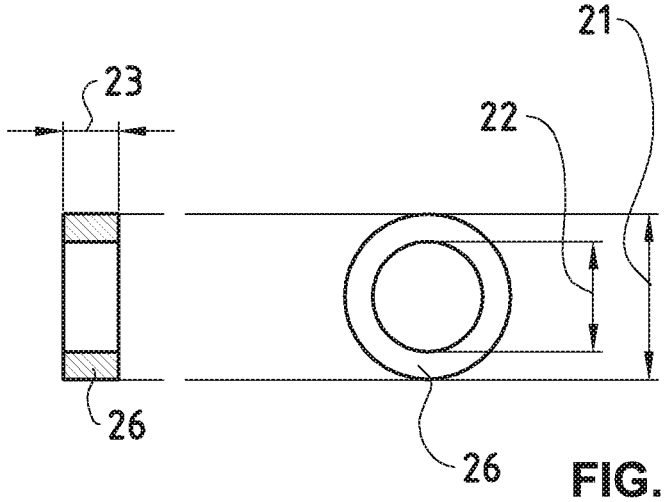
FIG. 5 shows a sealing element for use in the invention.
Figure 6:
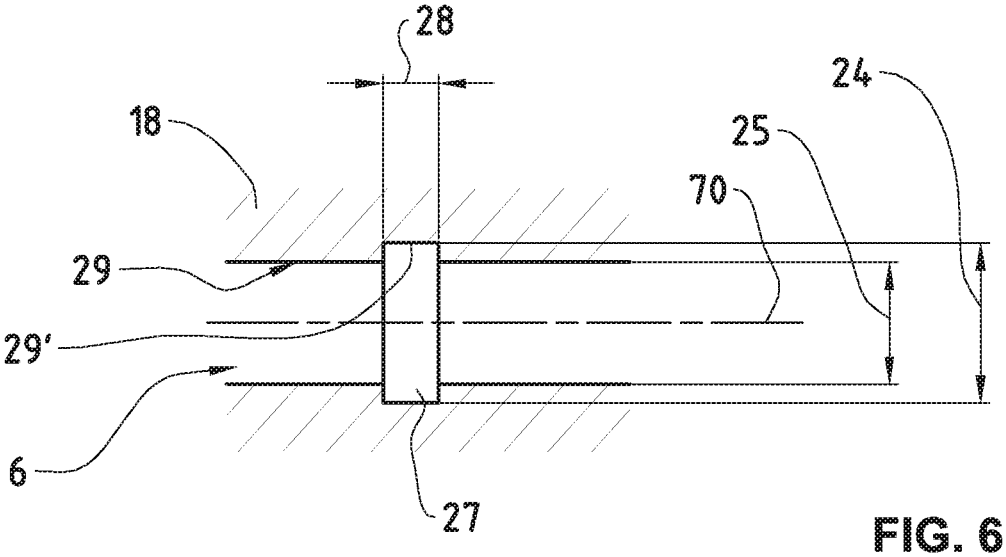
FIG. 6 shows in schematic cross-sectional view a channel of an anchorage according to the invention.

As shown in more detail in FIGS. 3 and 4A, 4B, the seal element 26 may advantageously be arranged in a correspondingly-shaped annular recessed region or recess 27 of the space 51, respectively, in the inner wall of the channel 6, for example in the inner wall of the tubular orifice element 18. The recess 27 corresponds to the predetermined axial location as mentioned before. The seal element 26 thus preferably has an annular, cylindrical or tubular shape, and the recess 27 is correspondingly shaped to receive the seal element 26. The seal element 26 and the recess 27 may be radially dimensioned such that the seal element 26 fits snugly in the recess 27 in the wall of channel 6 or orifice element 18. Alternatively, the seal element 26 may have an outer diameter 21 which, when not under radial tension or compression state, is marginally smaller than the diameter 24 of the recess 27 (see FIGS. 5 and 6). As another alternative the seal element 26 may have an outer diameter 21 which is marginally bigger than the diameter 24 of the recess 27. In this case the seal element 26 is under radial tension or compression, when fitted into recess 27. The seal element 26 preferably comprises an elastic material, and the inner diameter 22 of the relaxed seal element 26 is preferably slightly (5% to 25%) smaller than the outer diameter of the, preferably sheathed, strand 50 which will be fitted into the channel 6, so that the seal element is stretched elastically by the strand passing through it, and therefore grips tightly on to the outer surface of the strand 50, thereby forming a good seal. This stretching of the seal element 26 also can have the effect of increasing the outer diameter 21 of the seal element 26, with the result that the outer surface of the seal element 26 is pressed firmly radially against the corresponding surface 29' of the recess 27.

If the axial length 28 of the recess 27 is greater than the axial length 23 of the elastic sealing element 26, then the sealing element 26 may, when compressed within the recess 27, expand axially until if fills the recess. The ratio of the axial length 28 of the recess 27 to the axial length 23 of the sealing element 26 is preferably greater than 1.1 but less than 1.5. If it is less than 1.1, then the sealing element may be such that it is not radially compressed to any great extent, and may therefore by expelled from the recess as the strand is inserted. If it is greater than 1.5, on the other hand, a highly deformable elastic material is selected for the sealing element 26 in order for the sealing element 26 to deform sufficiently to fill the recess 27 and create a good seal when the strand 50 is introduced.

In one embodiment the seal element 26 comprises an annular, toroidal, cylindrical or tubular body comprising an elastically deformable material such as an elastomer or a flexible polymer, for example a polyurethane. The seal element 26 may be in other likely materials including various elastomers such as EPDM (ethylene propylene diene monomer), TPV (thermoplastic vulcanizates including thermoplastic vulcanizate rubber), TPE (thermoplastic elastomers), SBR (styrene butadiene rubber). Thus the seal element can be inserted through the first end 1 into the channel in a compressed state and expands into a lesser compressed state, when displaced into the recess 27. In another embodiment the seal element may be provided as an inflatable seal element. Thus the seal element may be introduced through the channel 6 in an uninflated state until placed at the predetermined axial location 27, and then be inflated to its sealing shape.

The volume of the annular recess 27, bounded on its outer periphery by the surface 29' of the recessed region 27, and on its inner periphery by the outer surface of the preferably sheathed strand 50, is referred to as the recess volume. The volume of the sealing element is referred to as the seal volume. The ratio of the seal volume to the recess volume is preferably in the range 0.8 to 1.3 If this ratio is less than 0.8, then the seal is not under sufficient elastic compression in at least one direction to form a good seal. If the ratio is greater than 1.3, on the other hand, the compression of the sealing element 26 is too great, and the sealing element 26 may be damaged when the strand 50 is inserted.

The axial length 23 of the seal element 26 is preferably greater than one fifth of, but less than one half of, the outer diameter 21 of the sealing element 26. If the axial length 23 is less than one fifth of the outer diameter 21 of the sealing element 26, then the sealing element is not rigid enough to retain its shape and orientation as it is be pushed/slid through the channel 6, and may begin to roll or collapse. If the axial length 23 is greater than half of the outer diameter 21 of the sealing element 26, then the sealing element is less easy to insert. It is advantageous to be able to insert the sealing element 26 with its cylindrical axis orthogonal to the axis 70 of the channel, since this merely requires the pinching of the sealing element together in order to make it fit into the channel. However, such an insertion requires the subsequent rotation of the sealing element 26 into its axially aligned orientation in the recess once it arrives at the predetermined axial location, and this rotation is impossible or significantly impeded if the axial length 23 of the sealing element 26 is greater than half of its outer diameter 21.

As an example, a typical standard diameter for a bare seven-wire strand, measured through the centres of three wires, is 15.7 mm. With its sheath, such a strand might typically have a diameter of approximately 19 mm. In this case, the diameter 22 of the opening through the seal element 26 (referred to as the inner diameter) when in its relaxed state may be 15 mm or 16 mm, for example. The nominal inner diameter 25 of the channel 6 may be 20 mm, while the diameter 24 of the recessed region 27 of the channel 6 may be 25 mm. The outer diameter 21 of the seal element 26 in its relaxed state may also be 25 mm, so that it fits snugly into the recess when in its relaxed state. Upon insertion of the sheathed part of the strand through the seal element 26, therefore, the seal element 26 is compressed with significant radial force between the outer wall 29' of the recess 27 and the outer surface of the sheathed strand 50. The seal material, and the dimensions of the seal element 26 and the channel 6 and recess 27, are chosen such that this compression is strong enough to form a reliable seal between the strand 50 and the wall 29' of the recess 27, yet not so strong that the strand 50 cannot be pulled through the seal element 26 without damaging either the seal element 26 or the sheath of the strand 50.

Preferably, the seal element 26 properties are chosen so that the seal element 26 has a compression set equal to or less than 25%, if possible equal to or less than 20% and more preferably equal to or less than 15%. Such a compression set ensures the seal element 26 recovers its form properly. The compression set expresses the amount of residual deformation relative to initial deformation under a given compression over a defined time and at a defined temperature. This compression set is a characteristic of sealing rings which is defined according to standards ISO 815 or DIN53517, for a compression at 70° C. during 24 h.

The axial length 28 of the recess 27 may advantageously be made larger (for example 10% to 50% larger) than the axial length 23 of the seal element 26, so that there may be some limited play between them along the axial direction when no strand is inserted, but so that the seal element 26 abuts against a side surface of the recess 27 which prevents the seal element 26 from being displaced out of the recess 27, at least towards the remote end 1 of the anchorage, when the strand 50 is pulled through the seal element 26. Making the axial length 28 of the recessed region 27 larger than the axial length 23 of the seal element 26 makes it easier for an operator to fit the seal element 26 into the recess 27 from outside the channel 6, by inserting the seal element 26 through the remote end 1 of the channel 6 and displacing it along the channel 6. It also makes it easier for the operator to verify that the seal element 26 is correctly seated in the recessed region 27: if the seal element 26 can be moved freely by a small axial distance within the recess, before the strand 50 is inserted, then the seal element 6 may be assumed to be correctly seated in the recess 27. If the seal element 26 resists any axial movement, on the other hand, then the operator can assume that it is not seated correctly.

Figure 7:
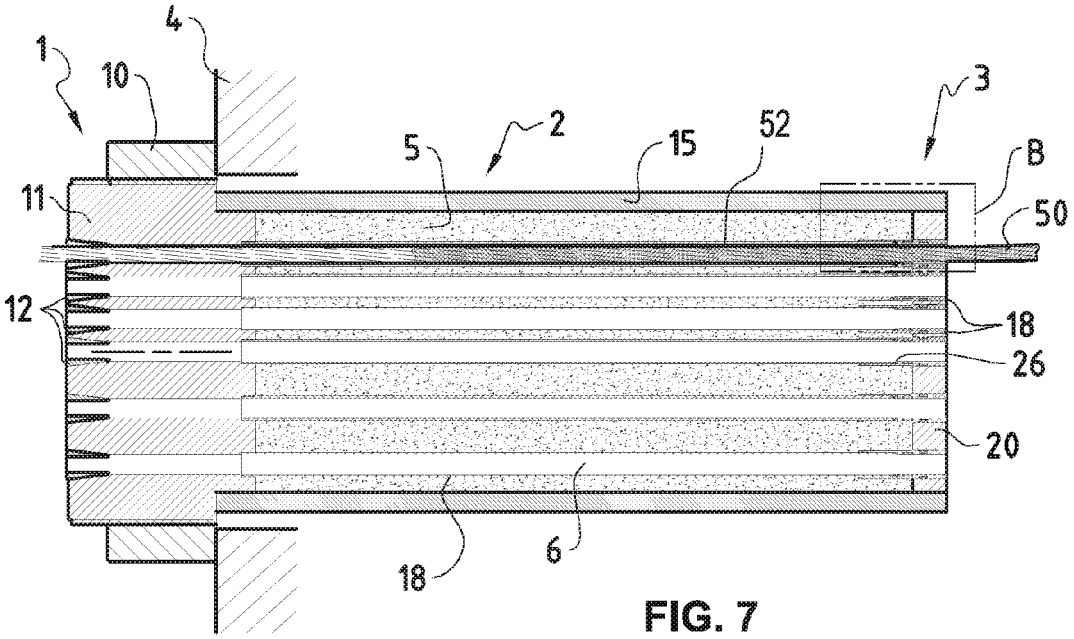
FIG. 7 shows a sectional view of a second example anchorage according to the invention.
Figure 8:
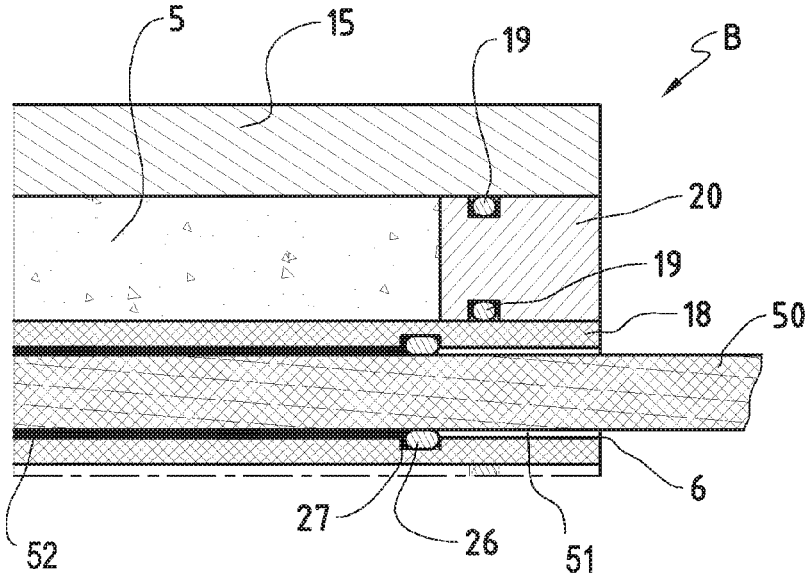
FIG. 8 shows an enlarged portion of the sectional view of FIG. 7.

FIGS. 7 and 8 show an example of a stressing end anchorage, which differs from the passive end anchorage of FIGS. 3 and 4A for example in that the anchorage is significantly longer, in order to accommodate the axial movement of the strands 50 through the anchorage as the strands 50 are tensioned. FIG. 7 shows how the channels 6 extend through a stressing end anchorage, the stressing end being the end of the cable at which the strands of the cable are tensioned. The stressing end anchorage is generally located at the more accessible end of the cable, where the strands can be pulled through the anchorage, for example by hydraulic jacks, until the strands are individually stressed to the required tension. The example anchorage illustrated in FIG. 7 comprises an anchor block 11, where strands 50 (only one of the strands is indicated in the figure) in the channels 6 are anchored by conical wedge sets 12 in corresponding conical bores in the anchor block 11. An adjustment ring 10 allows the anchorage to be positioned axially against a bearing surface of the structure, such as a bridge deck, which is to be supported and/or tensioned by the cable. As with the passive end anchorage of FIGS. 3 and 4A, the reference numeral 1 indicates the remote end (also referred to in this application as the second end) of the anchorage and of the channels 6, i.e. the ends of the channels 6 which are directed away from the main running part of the cable (not shown). Reference numeral 3, on the other hand, indicates the proximal end, also referred to as the first end, of the anchorage, and of the channels 6, i.e. the ends of the channels 6 which are directed towards the main running part of the cable. The body 2 of the anchorage may comprise a rigid transition pipe 15, which may be filled with a hardened material 5 such as a concrete or grout material, except for the volume occupied by the channels 6, which pass through the hard material. The channels 6 shown in the examples are substantially straight, and extend substantially parallel to each other and to the principal longitudinal direction of the cable, which is also referred to as the axial direction. The channels 6 may be formed by tubes or pipes 18 which may be viewed as extended versions of the orifice element 18 shown in FIGS. 3 and 4A.

The stressing end anchorage needs to be longer than the passive end anchorage, to allow for axial movement of the strand 50 during tensioning. In this case, the channels 6 through the anchor block 11 are effectively extended by means of the channel extension tubes 18, which are enclosed in a rigid structure such as solid grout or concrete 5. The transition tube 15 is rigid enough to support the end-plate 20, which may be made of steel or similar material, substantially rigidly at the exit region of the anchorage. The space 51 between the strand 50 and the inner wall of the (extended) channel 6 may be filled with corrosion-preventing wax or grease material, an elastomeric material or other suitable injection material. This filler material 52 is shown with black filling on FIGS. 7, 8 and 12. Like the seal 26, this filler material 52 can be replaced easily, by injection from the remote end 1, after replacement of the seal 26. A set of seals 19 may be arranged between the inner surface of the end-plate 20 and the orifice element 18 as well as between the outer surface of the end-plate 20 and the transition pipe 15 as shown in FIG. 8.

Enough sheath must be stripped from each strand 50 such that, once the strand 50 has been pulled through the channel 6 of the anchor block 11 and fully tensioned, the end of the sheath is located somewhere between the embedment point (where the anchor wedges 12 grip the strands) and the seal element 26, which prevents moisture from entering the anchorage from the proximal (first) end 3. As described above, the seal element 26 may be located in a recess 27 in the inner wall of the channel 6, or in the inner wall of an orifice element 18 of the channel 6. The predetermined axial location of the recess 27 is typically significantly nearer to the first end 3 of the channel than to the second end 1. The space 51 between the individual strand 50 and the wall of its individual channel 6 can then be filled with a material for protecting the strand against corrosion. A wax or a grease may be used as such a corrosion-preventing material, for example, or an elastomeric material may be injected into the cavity as a fluid and allowed to set, as mentioned above.

In general the seal element 26 and the recess 27 in the stressing end anchorage are essentially the same as the one described for the dead end anchorage above. In particular the dimensions of the seal element and the recess may have the same ratio relations and similar length and/or thicknesses.

If an individual strand 50 is to be replaced, the seal element 26 should be capable of providing at least as good a seal against the replacement strand as against the original. Also in case an individual strand 50 needs to be replaced the entire length of the strand is pulled through the existing seal element and may easily damage the seal element, which therefore has to be replaced. According to the method of the invention, therefore, the seal element 26 and the channel 6 are designed so that the seal element can be replaced from the remote end 1 of its channel 6, as described above. By arranging the seal elements 26 and the channels 6 so that the seal elements 26 can be replaced, it becomes practicable to fill the space between the strands 50 and the channel wall with a stiff, elastic and/or flexural filler material 52, while still retaining the ability to replace individual strands. In such a situation, the removal of the old strand 50 may result in significant damage to the filler material 52, and to the seal element 26. By using a replaceable seal element 26, it becomes possible to remove the old strand quickly, and if necessary to remove the old filler material 52, without any concern for damaging the old seal element 26. Thus, a corrosion-preventing material may be introduced into the cavity 51 around the strand 50 in the anchorage which has stiff, elastic and/or flexural properties. A polyurethane material may be injected as a liquid and allowed to harden to a predetermined hardness, for example. In this case, the seal element 26 may advantageously also be formed from a polyurethane material of predetermined hardness, to which the polyurethane filler material bonds strongly, thereby ensuring an excellent seal against moisture ingress.

The seal element 26 plays an important role in protecting the exposed end of the strand 50, particularly in the stressing end anchorage, but also in the passive end anchorage. The strands 50 are threaded into the anchorage and tensioned at a first point in time, and then re-tensioned at a second point in time or even once again at a third point in time, with the first and second or third points in time being separated by days, weeks or even months. It is therefore important that the sealing element 26 provides an excellent moisture-resistance during this time, in order to prevent exposing the ends of the strands 50 to the corrosive effects of moisture ingress. If a corrosion-preventing material such as the wax or grease or filler material 52 is to be injected into the space 51 surrounding the strand 50 in the channel 6, as mentioned earlier, this will normally be injected after first tensioning, and will therefore not offer any corrosion protection before the strand is tensioned to the final force e.g. at the third point in time. During this time, the role of the seal elements 26 is thus particularly important for protecting the exposed strand ends within their individual channels 6.

Furthermore the leaktightness of each sealing element may be checked after tensioning of the strand. This step may be provided by applying air pressure or vacuum to each individual channel 6, e.g. to the space 51 between the channel 6 and the strand 50. Preferably the pressure or vacuum is applied from the remote end 1 of the anchorage at block 11.

Figure 9:
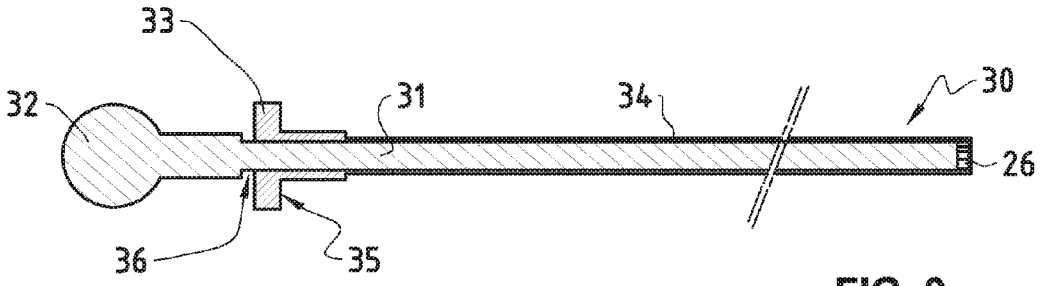
FIG. 9 shows a sectional view of an example of an insertion tool according to the invention.
Figure 10:
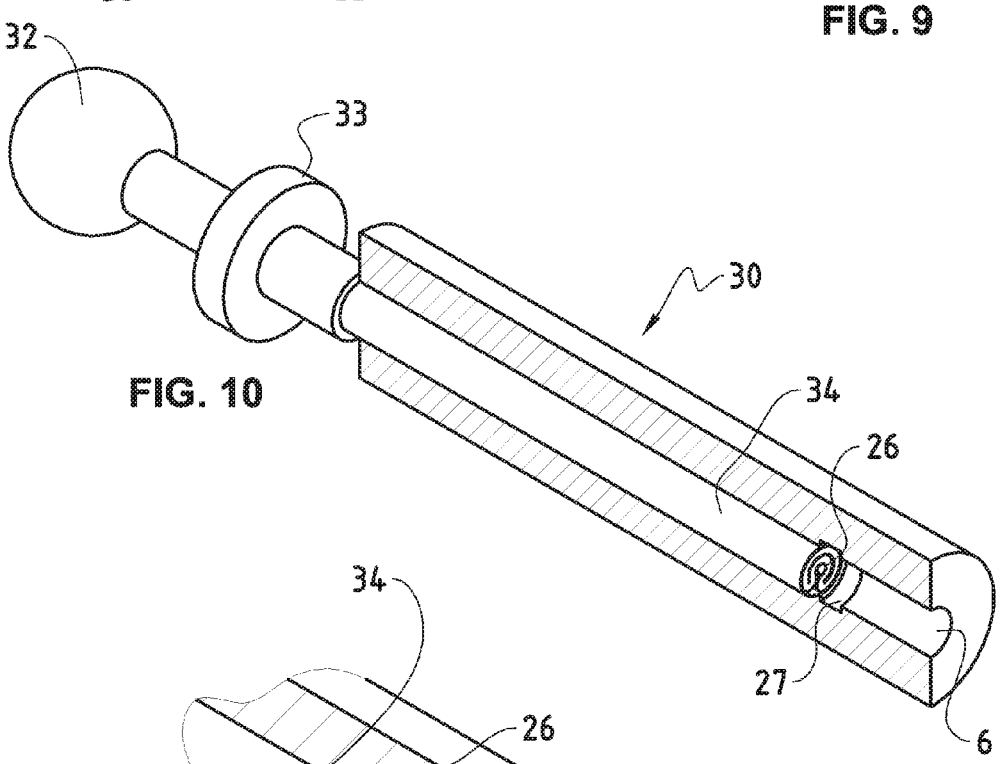
FIG. 10 shows an isometric, cut-away view of the insertion tool of FIG. 9.
Figure 11:
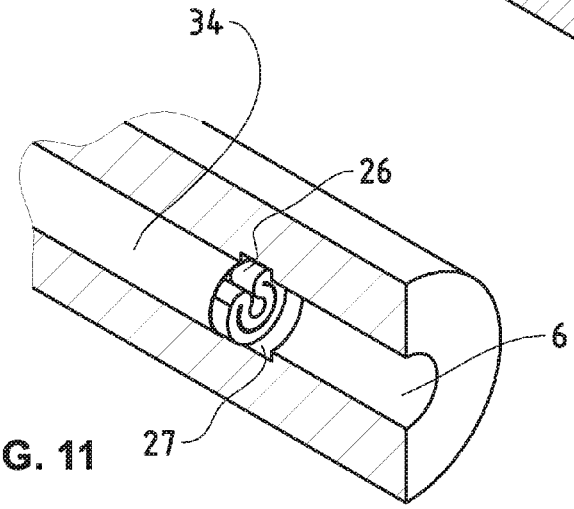
FIG. 11 shows an enlarged view of part of the insertion tool shown in FIGS. 9 and 10.

FIGS. 9 to 11 show an example of an inserting tool 30 which can be used for inserting the seal element 26 and moving it to the recess 27 provided at the predetermined axial position along the inner wall of the channel 6. The example insertion tool 30 is designed to be inserted from the second (remote) channel end, 1, of the channel 6, and comprises a tubular extension device 34, which comprises a seal-retaining device at the end, for retaining the seal element 26 in a compressed state while it is being displaced along the channel 6. The seal retaining device may enclose the seal element 26 radially, in order to hold it in compression, or it may comprise one or more protrusions and/or cavities for retaining the seal element 26 in a predetermined deformed shape, which has an outline profile smaller than the peripheral profile of the cross-section of the channel 6. Such a shape might be formed, for example, when one part of the seal element 26 is turned radially inwards and held in this position by the seal-retaining device.

Remote release device 31, also referred to as an ejector rod, passes through the tubular extension device 34 of the illustrated example, and can be advanced to eject the seal element 26 from the end of the extension device 34 into the recess 27. The extension device 34 may be provided with device 33, 35 for indicating when, and/or stopping the displacement into the channel when, the extension device has been inserted to the appropriate distance into the channel 6 for ejecting the seal element 26 into its recess 27. Thus the device 33, 35 is used as depth gauging device and/or displacement stopping device. A similar stop or indicator 36 may be provided on the ejector rod 31 for preventing an overshoot of the seal element 26 past the recess 27 if/when the seal element 26 is ejected. Thus the stop or indicator 36 serves as depth gauging device and/or ejection stopping device. The seal insertion operation is made easier if the recess 27 is slightly larger in the axial direction than the seal element 26, as discussed earlier.

Figure 12:
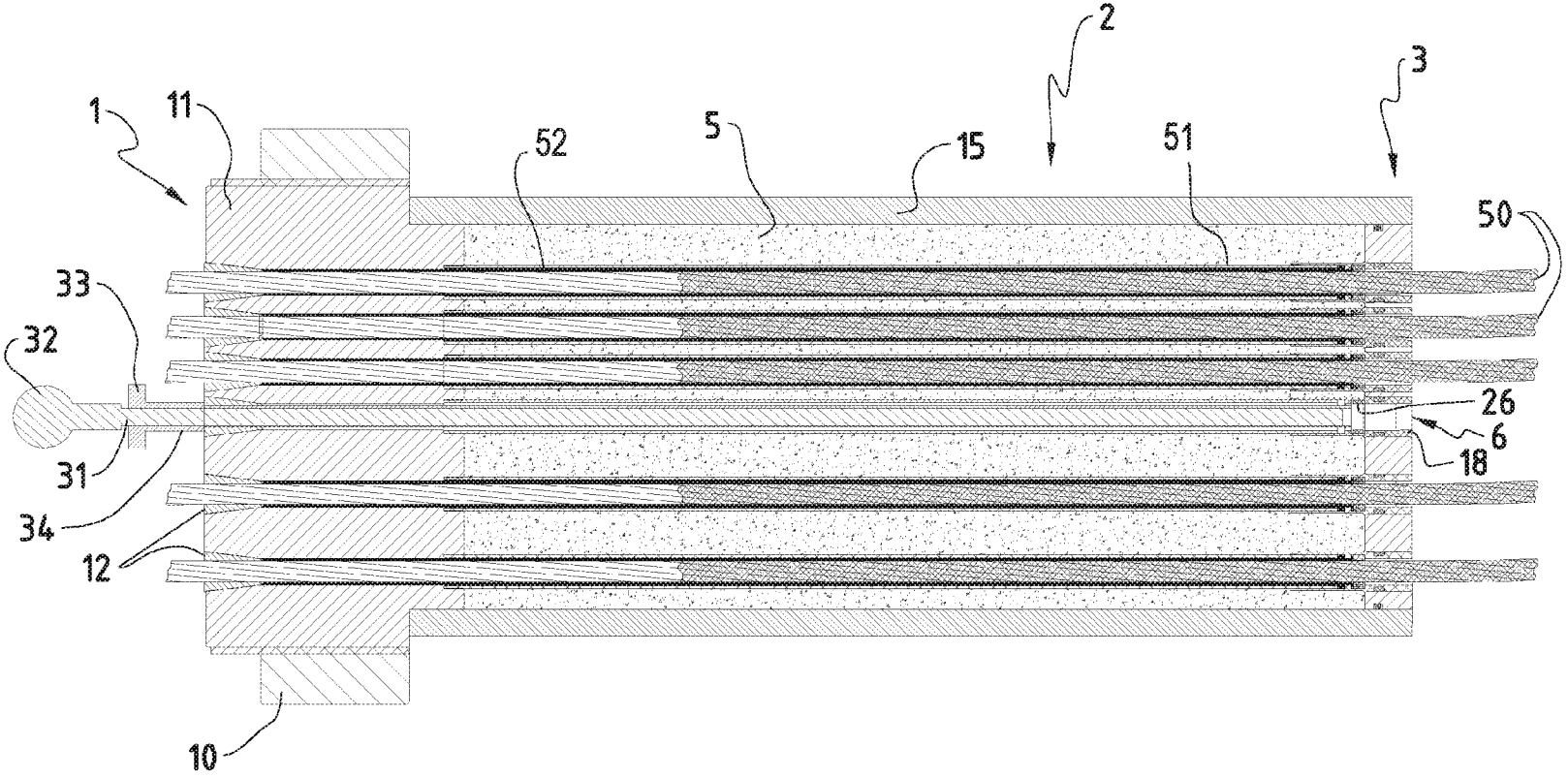
FIG. 12 shows a sectional view of the second example anchorage, as shown in FIG. 7, and the operation of an insertion tool as shown in FIGS. 9 to 11.

FIG. 12 shows how the inserting tool of FIGS. 9 to 11 may be used to insert a new seal element 26 into the channel 6 of a stressing end anchorage from the second (remote) end 1 of the channel 6. The anchorage is shown with all other strands fitted, with the result that access to the channel 6 from the first (proximal) end of the anchorage is severely restricted. The insertion tool 30 can be used to insert the seal element 26 into the recess 27 in the wall of the channel 6 from the second (remote) end 1 of the channel 6. The strands extending from the remote end 1 of the anchorage can be cut to strand tails comprising a specified length. The strand tails can be cut to a predetermined length of e.g. 30 mm-500 mm such as to permit access for gripping of the strand tail for detensioning, removal and insertion of new strand, depending on actual length of stay cable.

Figure 13:
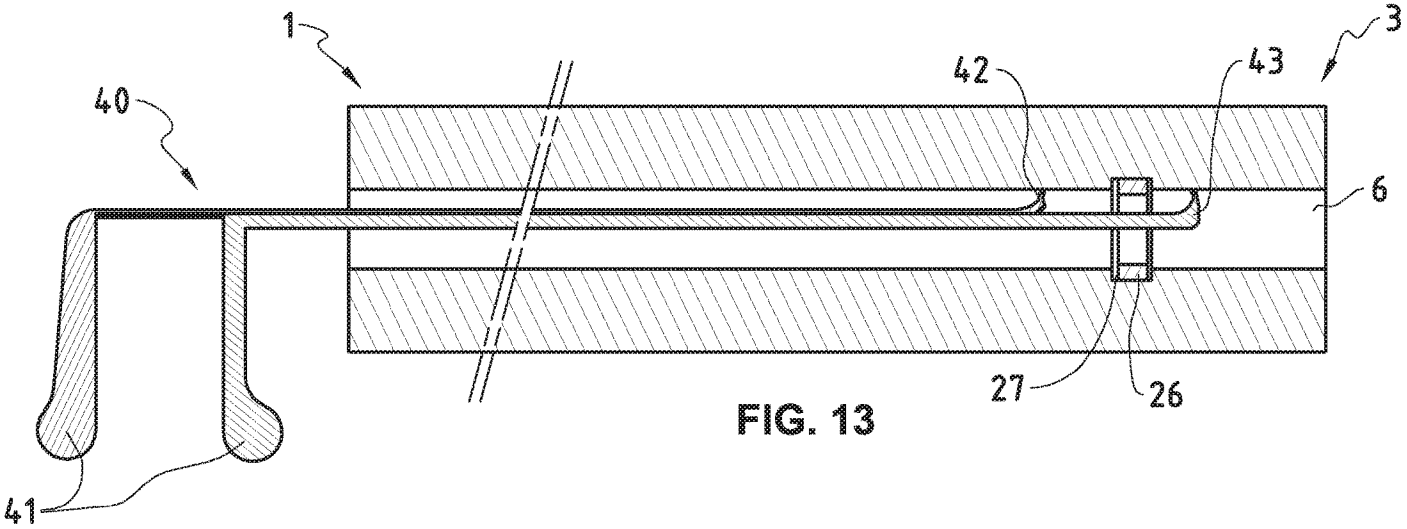
FIGS. 13 and 14 show an example of a seal removing tool for performing a removing step in accordance with a variant of the invention.
Figure 14:
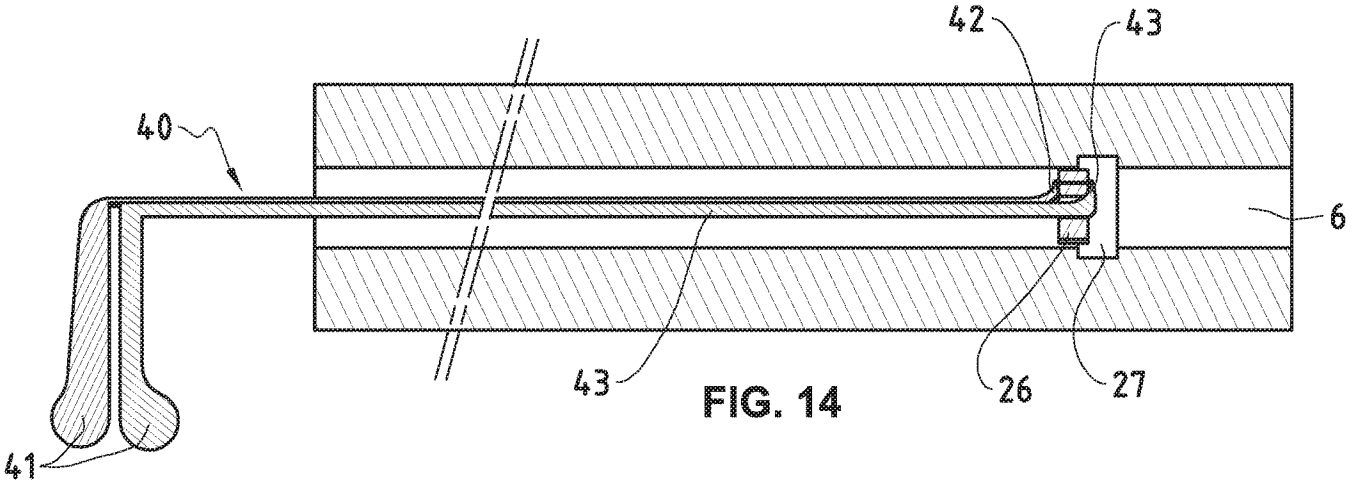

FIGS. 13 and 14 show an example of a seal-removal tool 40 which may be used to remove an existing seal element 26 from the recess 27 of channel 6. In the illustrated example, two longitudinal parts 42 and 43 are dimensioned to reach from the second end 1 of the channel to the recess 27, and are moveable relative to each other under control of a pistol-grip 41 to grip the seal element 26 and allow an operator to withdraw the seal element 26 from the channel 6. In order to make the withdrawal easier, the removal tool may be equipped with a compressing device (not illustrated) for squeezing or twisting or otherwise distorting the seal element 26 to make it pass more easily through the channel 6. Alternatively, a simple hook may also be sufficient to remove the seal element 26 from the channel 6.

In the previous text, the cable anchorage was illustrated in a non-limitative way in relation with a stay cable which anchorage was performed at its free end contained in the second channel end 6 by means of immobilising device such as conical wedges 12: Therefore, the present invention can also be applied to another type of anchorage of the stay cables, namely an anchorage at a portion of the stay cable remote from its free ends. When using a cable deviation saddle, under some circumstances, there is no possible displacement of portion of the strand located at the central portion of the saddle, which situation therefore corresponds to an anchorage with the saddle forming an immobilising device. This situation corresponds to WO2011116828 in which a bedding material 51 can be used in replacement of the usual material for protecting strands against corrosion of the strands in the saddle body

REFERENCE NUMBERS USED ON THE FIGURES

1 Second (remote) end of the cable (remote from the running part)
2 Body of the anchorage
3 First (proximal) end of the cable (exit end for the running part)
5 Hardened material of transition pipe 15
6 Anchorage channels
7 Principal longitudinal axis of the cable
8 Main running part of the cable
10 Adjustment ring
11 Anchor block
12 Conical wedges
13 Collar element
15 Transition pipe
18 Orifice element or channel extension tube
18A First piece of the orifice element
18B Second piece of the orifice element
19 Seals
20 End plate
21 Outer diameter of the seal element 26
22 Inner diameter of the seal element 26
23 Axial length of the seal element 26
24 Diameter of the recess 27
25 Nominal inner diameter of the channel 6
26 Seal element
27 Annular recessed region or recess
28 Axial length of the recess 27
29,29' Surface of the annular recessed region 27 (inner and outer walls)
30 Insertion tool
31 Remote release device
33, 35 Depth gauging-device and/or displacement stopping device
34 Tubular extension device
36 Stop or indicator
40 Seal-removal tool
41 Pistol-grip
42, 43 Longitudinal parts
50 Strand
51 Space
52 Filler material
70 Axis of the channel 6

The invention claimed is:

1. An insertion tool for displacing a seal element into a recess of a cable anchorage comprising:

a plurality of axial cylindrical channels in an anchor block, each channel individually accommodating a strand of a cable, wherein the channel extends along the whole length of the cable anchorage between a first channel end, proximal to a running part of the cable, and a second channel end remote from the running part of the cable; and a seal element positioned at a predetermined axial location of an inner wall of the channel, said inner wall of the channel comprising an annular or cylindrical recessed region at said predetermined axial location, said recessed region being longitudinally coaxial with the channel and accommodating said seal element so as to retain the seal element at said predetermined axial location during an axial displacement of the strand in the channel and provide a seal between the inner wall of the channel and the strand, when the strand is in the channel;

wherein the seal element and the second channel end of the channel are formed such that the channel is configured to receive the seal element through the second channel end, wherein the seal element and the inner wall of the channel are designed such that the seal element is axially displaced inside the channel from the second channel end to the recessed region, and wherein said seal element comprises an elastic material so that said seal element is elastically deformable to a compressed state, in which it has a radial outer dimension which is smaller than or equal to all diameters of the inner wall of the channel between said second channel end and said recessed region whereby said sealing element is removably arranged in said recessed region the insertion tool comprising:

a seal retaining and/or aligning device for maintaining the seal element in its radially compressed state and coaxially aligned with the channel during a displacing step of said seal element inside the channel, a displacement extension device for displacing the seal element, in the compressed state, through the channel from the second channel end to the predetermined axial location, and a remote release device, operable from outside the second channel end of the channel, for releasing the seal element from the seal retaining and/or aligning device such that the seal element substantially regains its fitted state in the recessed region of the channel.

2. The insertion tool according to claim 1, wherein the seal retaining and/or aligning device is adapted to hold the seal element in the compressed state such that a part of an annular or cylindrical outer surface of the seal element is turned radially inwards, and such that the seal element remains substantially coaxial with the channel.

3. The insertion tool according to claim 1, wherein the retaining and/or aligning device comprises a seal holding device for at least partially enclosing the seal element in its compressed condition, coaxial with the channel, and wherein the remote release device comprises an ejection device for ejecting the seal element from the seal retaining and/or aligning device into the recessed region.

4. The insertion tool according to claim 1, wherein the displacement extension device comprises a first depth gauging device or a displacement stopping device for indicating when the seal element has reached the predetermined axial position or stopping the displacement of the seal element when the seal element has reached the predetermined axial position.

5. The insertion tool according to claim 1, wherein the displacement extension device comprises a second depth gauging device or an ejection stopping device for indicating when the seal element has reached the recessed region or stopping the ejection of the seal element when the seal element has reached the recessed region.

6. A method of replacing a strand of a cable in an axial channel of a cable anchorage, said cable anchorage comprising:

a plurality of axial cylindrical channels in an anchor block, each channel individually accommodating a strand of a cable, wherein the channel extends along the whole length of the cable anchorage between a first channel end, proximal to a running part of the cable, and a second channel end remote from the running part of the cable; and a seal element positioned at a predetermined axial location of an inner wall of the channel, said inner wall of the channel comprising an annular or cylindrical recessed region at said predetermined axial location, said recessed region being longitudinally coaxial with the channel and accommodating said seal element so as to retain the seal element at said predetermined axial location during an axial displacement of the strand in the channel and provide a seal between the inner wall of the channel and the strand, when the strand is in the channel;

wherein the seal element and the second channel end of the channel are formed such that the channel is configured to receive the seal element through the second channel end, wherein the seal element and the inner wall of the channel are designed such that the seal element is axially displaced inside the channel from the second channel end to the recessed region, and wherein said seal element comprises an elastic material so that said seal element is elastically deformable to a compressed state, in which it has a radial outer dimension which is smaller than or equal to all diameters of the inner wall of the channel between said second channel end and said recessed region whereby said sealing element is removably arranged in said recessed region, the method comprising the following steps:

a strand removal step, in which one strand is removed from its corresponding channel through the second channel end;

a seal-removal step, in which the seal element disposed around said one strand is removed through the second channel end;

a seal-lining step, in which a new seal element is introduced through the second channel end and displaced axially inside the channel from said channel end to said recessed region; and a strand replacement step in which a new strand is inserted into said channel through the second channel end.

7. The method according to claim 6, wherein the seal element is held in the compressed state during its introduction into the channel and/or during its axial displacement inside the channel towards the recessed region, and wherein the seal element substantially reverts to its fitted state upon reaching the recess.

8. The method according to claim 6, wherein said seal-removal step is implemented with a removal tool for removing an existing seal element from the recessed region of said cable anchorage, said removal tool comprising two longitudinal parts moveable relative to each other to grip said seal element.

9. The method according to claim 6, wherein the strand removal step comprises further at least partially removing a filler material from the channel.

10. The method according to claim 6, comprising further, after said strand replacement step, a step of checking a leaktightness of the seal element when the strand is in the channel by applying air pressure or vacuum to a space between the channel and the strand.

11. The method according to claim 6, wherein said second channel end is equipped with strand-immobilizing device.

12. The method according to claim 6, wherein the ratio of the axial length of the recessed region to the axial length of the sealing element is greater than 1.1 but less than 1.5, whereby said sealing element is removably arranged in said recessed region.

13. The method according to claim 6, wherein the recessed region receiving said seal element is defined by a two-piece part.

14. The method according to claim 6, wherein the seal element has a compression set equal to or less than 25%.

15. The method according to claim 6, wherein the elastic material is an elastomer, which includes a polyurethane, a EPDM (ethylene propylene diene monomer), a TPV (thermoplastic vulcanizates), TPE (thermoplastic elastomers) or SBR (styrene butadiene rubber).

16. The method according to claim 6, wherein said cable further comprises bedding cushions, each bedding cushion individually extending substantially in the channel around the strand, in a space extending from the seal element in direction to the second channel end.

17. The method according to claim 16, wherein said second channel end is equipped with strand-immobilizing device and wherein said bedding cushion extends from said seal element to said strand-immobilising-device.

18. The method according to claim 16, wherein said bedding cushion comprises a bedding material having a durometer at 23° C. which is in the range 10 to 70 Shore.

19. The method according to claim 6, wherein the ratio of the volume of the seal to the volume of the recessed region is in the range 0.8 to 1.3.

* * * * *